US007111805B2

(12) United States Patent
Notarnicola

(10) Patent No.: US 7,111,805 B2
(45) Date of Patent: Sep. 26, 2006

(54) DISPENSER WITH CAM CONTROLLED BLADES

(75) Inventor: Daniel C. Notarnicola, Middletown, NJ (US)

(73) Assignee: von Drehle Corporation, Hickory, NC (US)

( * ) Notice: Subject to any disclaimer, the term of this patent is extended or adjusted under 35 U.S.C. 154(b) by 0 days.

(21) Appl. No.: 11/351,597

(22) Filed: Feb. 10, 2006

(65) Prior Publication Data

US 2006/0124680 A1 Jun. 15, 2006

Related U.S. Application Data

(62) Division of application No. 09/475,500, filed on Dec. 30, 1999, now Pat. No. 7,025,301.

(51) Int. Cl.
*B65H 75/18* (2006.01)

(52) U.S. Cl. ..... 242/603

(58) Field of Classification Search ..... 242/593, 242/615.3; 221/63, 44, 304
See application file for complete search history.

(56) References Cited

U.S. PATENT DOCUMENTS

| | | | |
|---|---|---|---|
| 1,297,110 | A | 3/1919 | Davis |
| 3,795,355 | A | 3/1974 | Gerstein |
| 3,843,017 | A | 10/1974 | Harrison |
| 3,982,659 | A | 9/1976 | Ross |
| 4,138,034 | A | 2/1979 | McCarthy |
| 4,244,502 | A | 1/1981 | Reed |
| 4,353,480 | A | 10/1982 | McFadyen |
| 4,905,868 | A | 3/1990 | Beane et al. |
| 5,141,171 | A | 8/1992 | Yang |
| 5,211,308 | A | 5/1993 | Decker et al. |
| 5,215,211 | A | 6/1993 | Eberle |
| 5,263,607 | A | 11/1993 | Temesvary et al. |
| 5,273,184 | A | 12/1993 | Rizzuto |

(Continued)

*Primary Examiner*—John Q. Nguyen
(74) *Attorney, Agent, or Firm*—Summa, Allan & Additon

(57) ABSTRACT

A dispenser for feeding perforated paper towels from a continuous roll of paper towels. The apparatus includes a dispenser body for containing the towel roll and an adjustable nozzle attached to the dispenser body for dispensing an end portion of the continuous roll. The nozzle includes a base having a centralized opening; an upper blade having a first cutaway portion; and a lower blade slidably nested with the upper blade, the lower blade having a second cutaway portion which aligns with the first opening to form a unitary opening aligned with the base centralized opening. A cam assembly is positioned adjacent to one of the upper and lower blades for selectively adjusting the size of the unitary opening. At least one gear is connected to the base and intermeshing with at least one gear rack positioned on the upper and lower blades. The gear provides for equal movement between the upper blade and the lower blade when the opening is adjusted. A removable slide having a locking tab selectively locks the slide to the nozzle for maintaining the nozzle opening in a preset position. Also, the cam assembly positioned adjacent to one of the upper and lower blades for selectively adjusting the size of the unitary opening is attached to the slide whereby removing the slide removes the cam assembly and allows at least one of the blades to open to permit the roll of paper towels to be more easily replaced.

32 Claims, 4 Drawing Sheets

U.S. PATENT DOCUMENTS 5,335,811 A 8/1994 Morand
5,346,064 A 9/1994 Rizzuto
5,370,338 A 12/1994 Lewis
5,715,971 A 2/1998 Morand
5,785,274 A 7/1998 Johnson
5,857,642 A 1/1999 Zinnbauer
6,089,499 A 7/2000 Robinson

DISPENSER WITH CAM CONTROLLED BLADES

CROSS-REFERENCE TO COMMONLY ASSIGNED APPLICATIONS

This application is a divisional application of commonly assigned U.S. patent application Ser. No. 09/475,500 filed on Dec. 30, 1999, now U.S. Pat. No. 7,025,301, which is incorporated by reference in its entirety. Accordingly, this application claims the benefit of the priority date of U.S. patent application Ser. No. 09/475,500.

BACKGROUND OF THE INVENTION

The present invention relates generally to a dispensing apparatus and, more particularly, to an apparatus for dispensing paper towels from a continuous roll of towels, which does not require re-adjustment each time a new roll is put in the dispenser.

Paper towel dispensers are commonly used for storing and dispensing products such as toilet tissue, hand towels, and others. Towels, for example, are often stored as a continuous roll paper sheet perforated at regular intervals to define individual towels and rolled into a cylindrical tube. The towel roll is housed in a container and dispensed by feeding the end of the paper roll through an opening, such as a slot or a nozzle. A user grasps the exposed end of the towel and pulls off a towel-length section, thereby exposing the end of the next section to be used.

Unfortunately, most prior-art paper towel dispensers have a number of shortcomings. First, the mechanisms used for dispensing the paper are complicated. For example, many mechanisms require the paper towel sheet to be initially fed through a variety of slots, turns, rollers, and passages. Thus, the process of installing a roll in such dispensers is often time consuming and difficult, as the towel must be manipulated through the numerous bends and turns which are often small and difficult to access. Once threaded, the paper sheet, if pulled too hard by the user, is liable to tear at a point before the sheet exits the dispenser, requiring the paper to be re-threaded.

Second, such prior-art dispensers, because they comprise numerous mechanical components, are often more expensive than less complicated dispensers and require additional maintenance to keep them in proper working condition.

In addition, most present towel dispensers accommodate a single size or strength of paper towel unless the dispenser is modified by service personnel. As a result, variations in the characteristics—such as thickness or strength—of the paper due to different brands, styles, or manufacturing variances produce dispenser problems, such as the paper being too wide or too narrow to be threaded through the dispenser. For example, towels are perforated to help control the size of the towel and provide an aesthetically pleasing edge when the towel is torn from the roll. Changes in the perforation resistance can result in the dispenser not adequately holding and tearing the roll, thereby causing additional sheets to be inadvertently pulled from the dispenser, which in turn produces wasted towels, frustrated users, and additional paper expense. Conversely, when perforation resistance is less than the dispenser setting, the towels tear from the roll without pulling the next sheet into position. The dispenser must then be opened—often by service personnel rather than the towel user—and the towel re-threaded through the opening. In summary, most current dispensers are unable to accommodate a variety of sizes without requiring timely and troublesome re-adjustments each time a new roll is put in the dispenser.

Thus there remains a need for a new and improved paper towel dispenser in which the paper roll is easily threaded and can be easily and quickly refilled while, at the same time, can automatically handle varying sizes and strengths of paper without requiring re-adjustment each time a new roll of paper towels is loaded into the dispenser.

SUMMARY OF THE INVENTION

The present invention is directed to a dispenser for feeding perforated towels from a continuous roll of towels. In the preferred embodiment, the towel roll is formed from paper or other similar materials. The apparatus includes a dispenser body for containing the paper towel roll and an adjustable outlet or nozzle that is attached to the dispenser body for dispensing an end portion of the continuous roll.

The nozzle includes: a base having a centralized opening; a lower blade having a first cutaway portion; and an upper blade that is slidably nested with the lower blade and having a second cutaway portion which aligns with the first cutaway portion to form a unitary opening aligned with the centralized opening of the base. A cam assembly for selectively adjusting the size of the unitary opening is positioned adjacent to one of the upper and lower blades. At least one gear, intermeshing with at least one gear rack positioned on the upper and lower blades, is connected to the base. The gear provides for equal movement of the upper blade and the lower blade while adjusting the size of the unitary opening, thus maintaining the unitary opening in a centered position.

In the preferred embodiment, a removable slide having a locking tab selectively locks the slide to the nozzle and maintains the nozzle opening in a preset position. The cam assembly is positioned adjacent to one of the upper and lower blades in order to selectively adjust the unitary opening and is also attached to the slide. Removing the slide also removes the cam assembly and permits at least one of the blades to open to allow the roll of paper towels to be easily replaced.

To reduce the amount of debris coming into contact with the blades, the dispenser may further include a cover positioned over the blades such that the blades are contained within the base and the slide. The cover may include a downwardly extending funnel to guide the toweling into the unitary opening.

Accordingly, one aspect of the present invention is to provide a dispenser for feeding perforated towels from a continuous roll of towels. The apparatus includes a dispenser body for containing the paper towel roll and an adjustable nozzle for dispensing an end portion of the continuous roll attached to the dispenser body. The nozzle further includes: (i) an upper blade having a first cutaway portion; (ii) a lower blade, slidably nested with the upper blade, having a second cutaway portion which aligns with the first opening to form a unitary opening; and (iii) a cam assembly, positioned adjacent to one of the upper and lower blades, for selectively adjusting the size of the unitary opening.

Another aspect of the present invention is to provide an adjustable nozzle for feeding perforated towels from a continuous roll of towels contained in a dispenser. The apparatus includes: a base having a centralized opening; an upper blade having a first cutaway portion; a lower blade, slidably nested with the upper blade, having a second cutaway portion which aligns with the first cutaway portion to form a unitary opening aligned with the centralized base opening; a cam assembly, positioned adjacent to one of the upper and lower blades for selectively adjusting the size of the unitary opening; and at least one gear connected to the base and intermeshing with at least one gear rack positioned on the upper and lower blades, the gear providing equal movement between the upper blade and the lower blade.

Still another aspect of the present invention is to provide a dispenser for feeding perforated towels from a continuous roll of towels. The apparatus includes: a dispenser body for containing the paper towel roll; an adjustable nozzle attached to the dispenser body for dispensing an end portion of the continuous roll. The nozzle includes: (i) a base having a centralized opening; (ii) an upper blade having a first cutaway portion; (iii) a lower blade slidably nested with the upper blade, having a second cutaway portion which aligns with the first cutaway portion to form a unitary opening aligned with the centralized base opening; (iv) a cam assembly positioned adjacent to one of the upper and lower blades for selectively adjusting the size of the unitary opening; and (iv) at least one gear connected to the base and intermeshing with at least one gear rack positioned on the upper and lower blades, the gear providing equal movement between the upper blade and the lower blade; and a removable slide having a locking means for selectively locking the slide to the nozzle for maintaining the nozzle opening in a preset position.

These and other aspects of the present invention will become apparent to those skilled in the art after a reading of the following description of the preferred embodiment when considered with the drawings.

DESCRIPTION OF THE PREFERRED EMBODIMENTS

Figure 1:
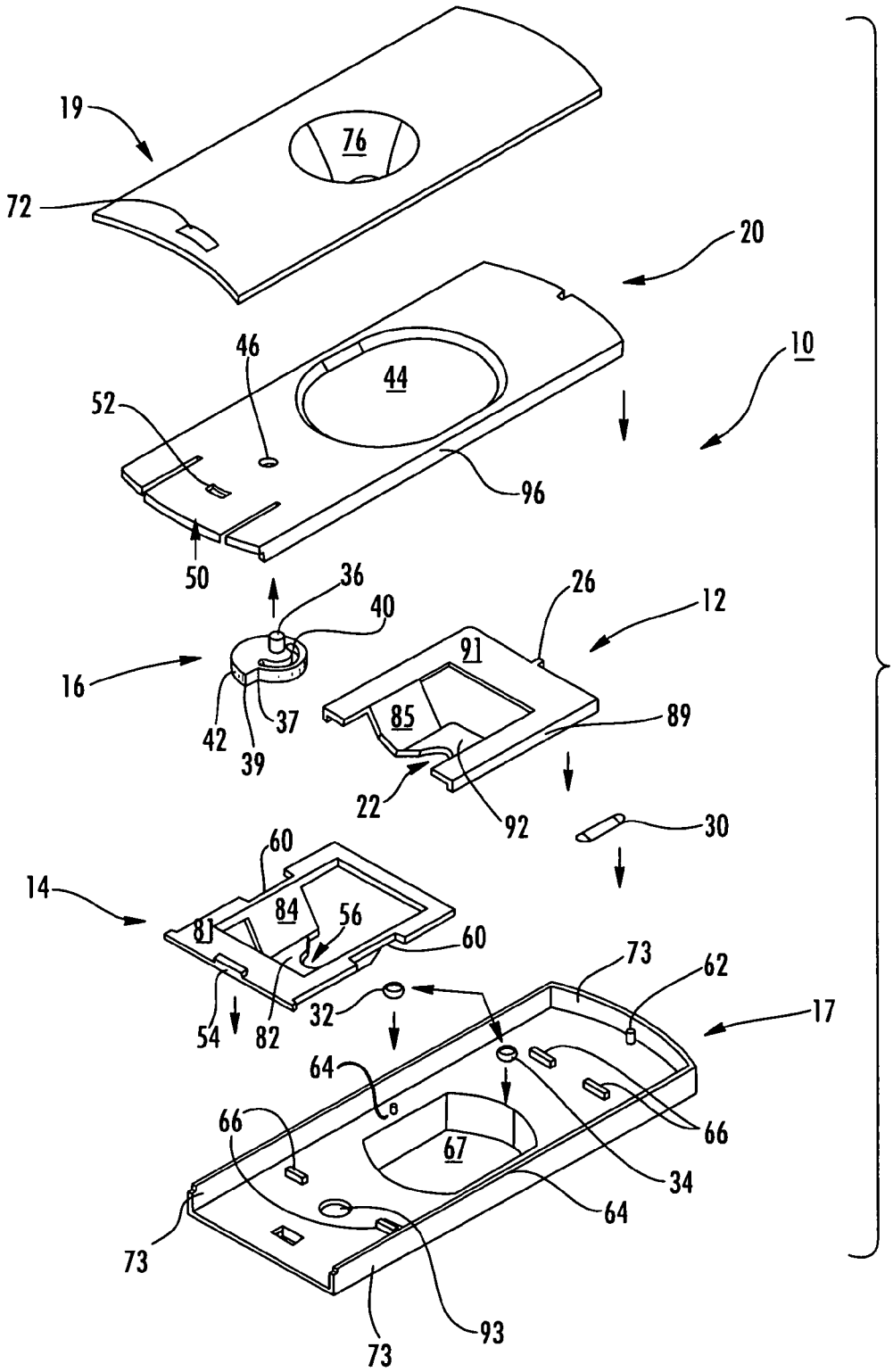
FIG. 1 is an exploded perspective view illustrating a dispenser nozzle constructed in accordance with the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms. Additionally, the terms "towel," "toweling," "paper toweling," "roll," and the like refer to a continuous roll of towels that have perforations to allow a user to tear individual towels from the roll.

Referring now to the drawings in general and FIG. 1 in particular, it will be understood that the illustrations are for the purpose of describing a preferred embodiment of the invention and are not intended to limit the invention thereto. As best seen in FIG. 1, a dispenser nozzle, generally designated 10, is shown constructed according to the present invention. The dispenser nozzle 10 includes a cover 19, a slide 20, a cam 16, an upper blade 12, a lower blade 14, a base 17, and gears 32 and 34.

Figure 2:
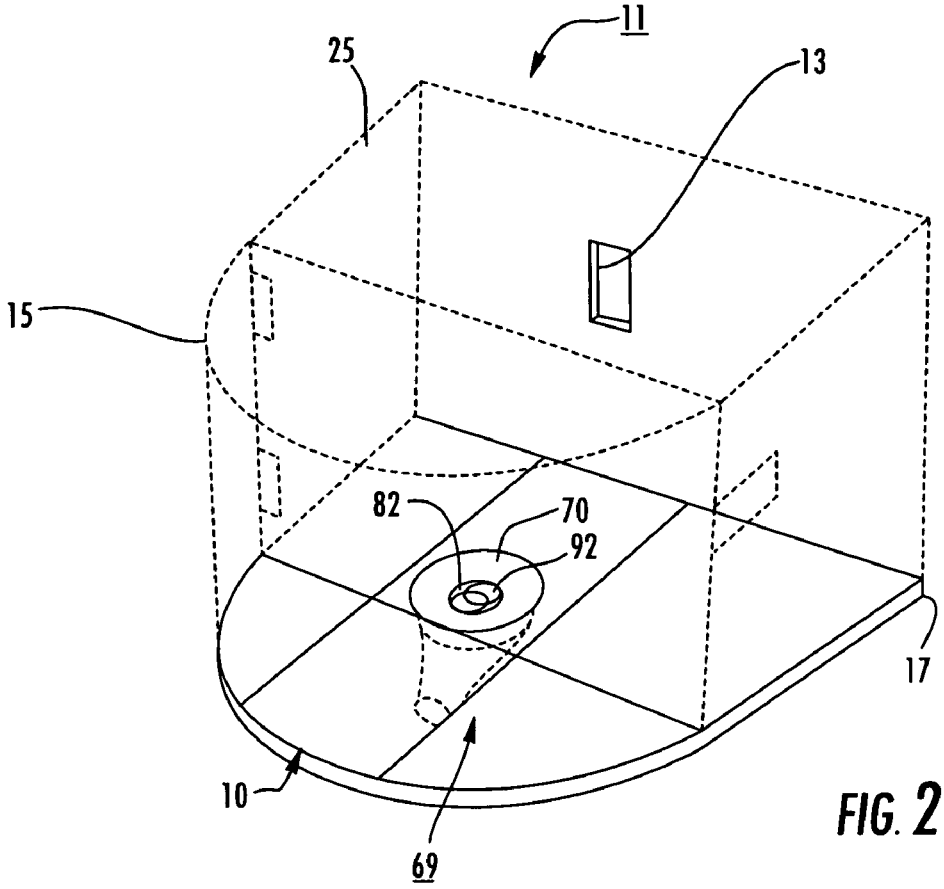
FIG. 2 is a perspective view of a dispenser body including the nozzle shown in FIG. 1.
Figure 3:
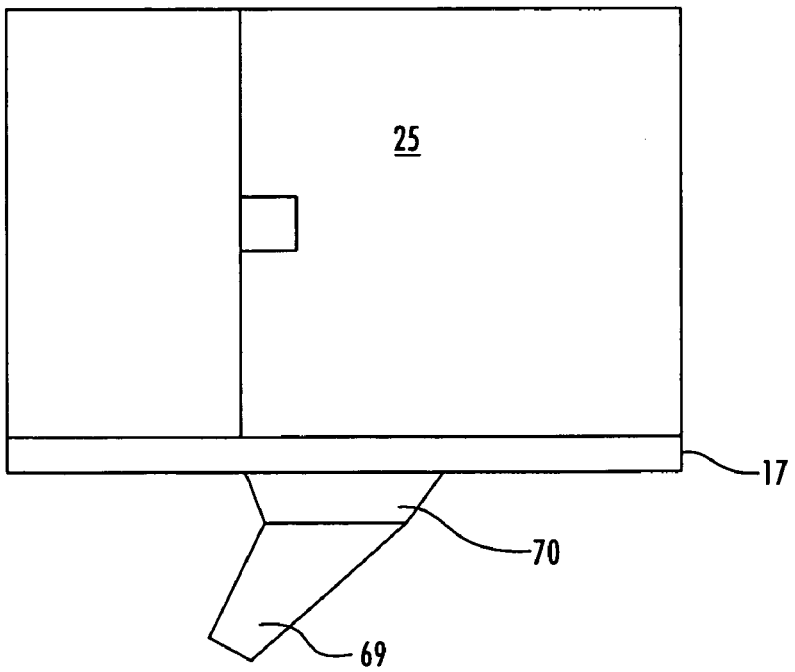
FIG. 3 is a side view of the dispenser body shown in FIG. 2.

FIGS. 2 and 3 show the dispenser body 11 including the dispenser nozzle 10 of the present invention. The dispenser body 11 is shown in dotted lines in FIG. 2 to better illustrate how the nozzle 10 fits into the base of the dispenser body. The dispenser body 11 is sized to contain a roll of towels such that the end of the roll passes out of the dispenser through the dispenser nozzle 10 for use by a user. The dispenser body 11 protects the roll from the elements—such as dirt and water—and may include hanging mechanism apertures 13 on the back panel for inserting a fastener for attachment to a wall or other surface. In the preferred embodiment, the axis of the roll upon which the toweling is wound is maintained perpendicular to the dispenser nozzle 10, allowing the free end to be pulled and uncoiled through the dispenser nozzle 10. The dispenser body 11 further includes an opening means to allow for the dispenser body to open for refilling additional rolls of paper towels. As shown in FIGS. 2 and 3, the dispenser body may include a front panel 15 pivotally hinged to a back section 25 to provide access for inserting a toweling roll into the interior of the dispenser body 11.

The dispenser nozzle 10 is connected to the dispenser body 11 and functions to direct the towels out of the dispenser and to a user. The dispenser nozzle 10 is adjustable in order to provide an opening having a range of sizes in order to accommodate various toweling dimensions. Although other positions are feasible, the nozzle is preferably positioned on a lower surface of the dispenser body 10, as illustrated in FIGS. 2 and 3.

Figure 4:
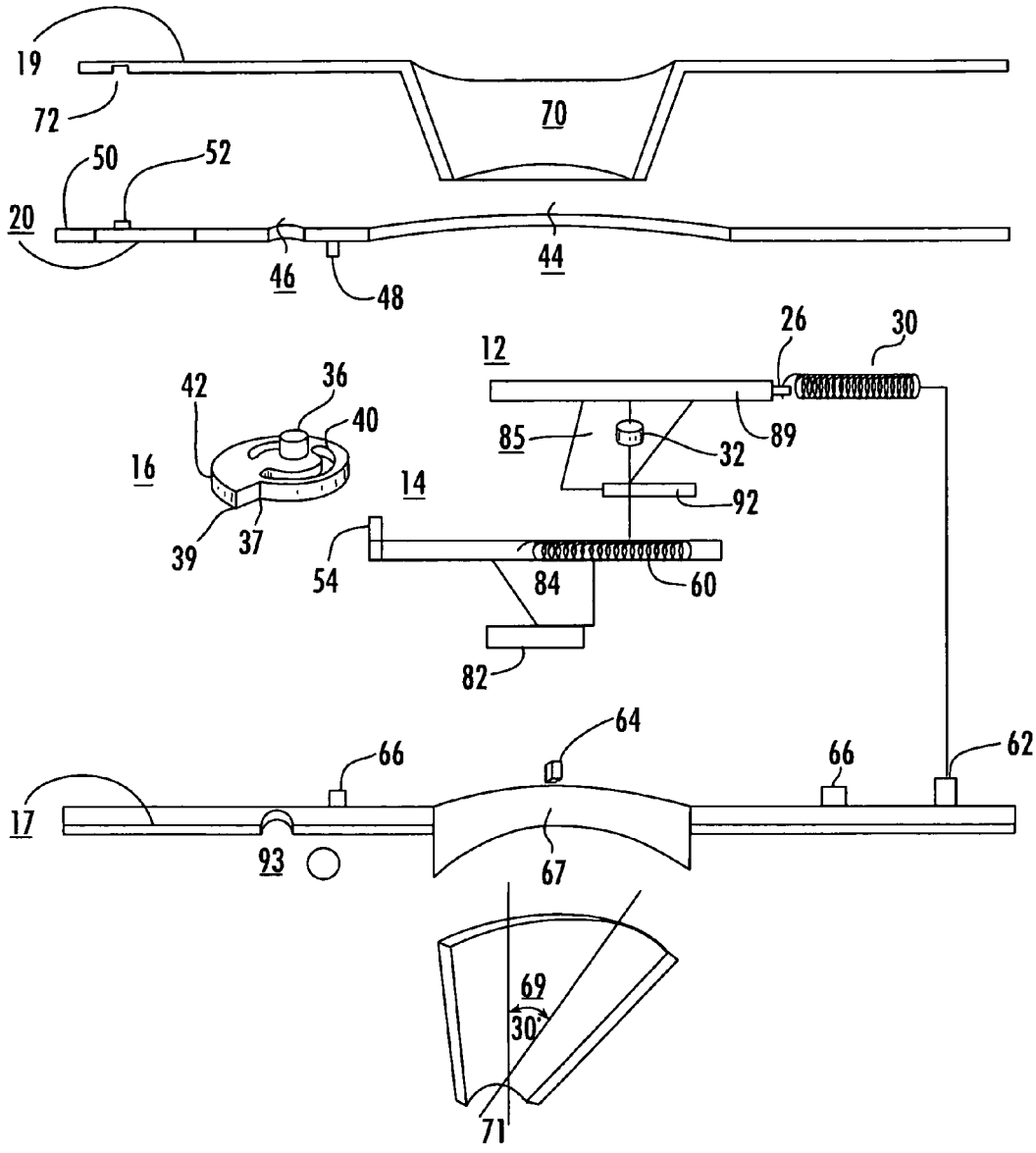
FIG. 4 is a cross-sectional, exploded side view of the dispenser nozzle shown in FIG. 1, further illustrating the relationship between the different elements of the mechanism.

FIG. 4 is a cross-sectional side view of the dispenser nozzle 10. A base 17 is positioned on the outer edge of the dispenser nozzle 10, away from the roll of towels. An opening 67 allows the paper roll to exit from the dispenser nozzle 10. A funnel 69 having a mouth 71 may be removably attached to the outer end of the opening 67. In order to better direct the towels toward a user as they exit from the dispenser nozzle 10 through the opening 67, the mouth 71 of the funnel 69 may incline or bias at an angle away from the central axis of the opening 67 and towards the user. In the preferred embodiment, the mouth 71 forms an angle of about 30 degrees as shown in FIG. 4. This arrangement has been found to further aid in proper and repeatable dispensing of the towel when compared with a conventional, unangled nozzle.

In the preferred embodiment, gear mounts 64, positioned on opposite sides of the opening 67, extend outward from the upper surface of the base 17 for mounting gears 32 and 34 and provide for rotational attachment of the gears 32 and 34 for controlling the positioning of the upper blade 12 and lower blade 14. Blade stops 66 extend outward from the upper surface of the base 17 on each side of the opening 67 to control the positioning of the upper blade 12 and lower blade 14. Biasing member connector 62 is positioned at one end of the upper surface of the base 17 for attachment of a biasing member 30, such as a spring, to one of the blades. An outer wall 73 extends around the outer edge of the base 17, as illustrated in FIG. 1, to contain the elements of the dispenser nozzle 10.

Figure 5:
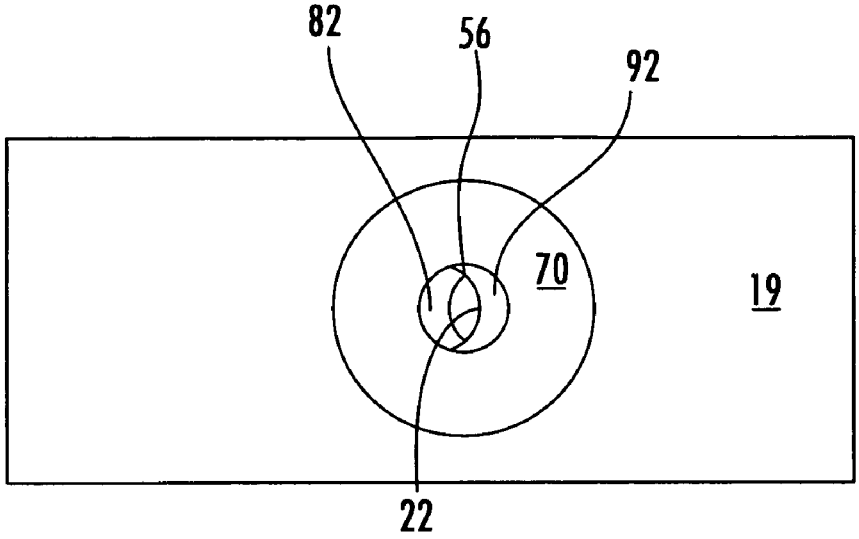
FIG. 5 is a top view of the assembled dispenser nozzle.
Figure 6:
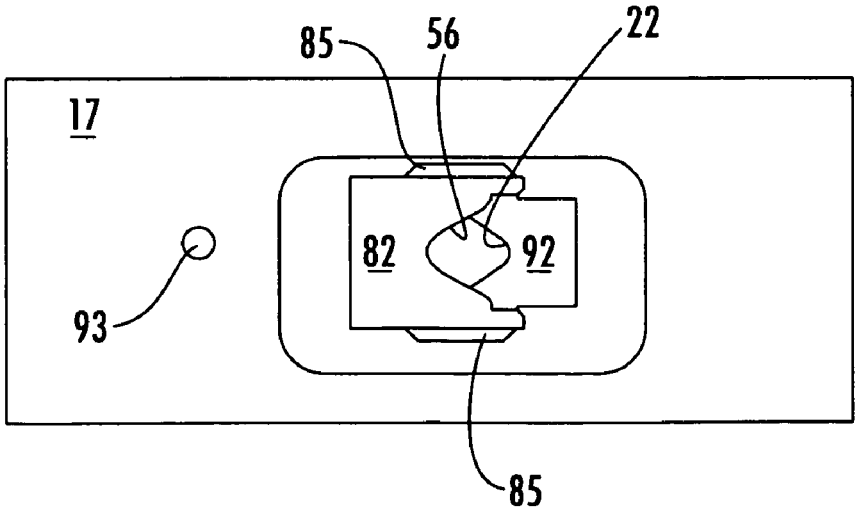
FIG. 6 is a bottom view of the assembled dispenser nozzle.

The upper blade 12 and lower blade 14 nest together to control the size of the opening through which the paper toweling extends. Top and bottom views of the nesting relationship of the upper blade 12 and lower blade 14 are shown in FIGS. 5 and 6, respectively. The lower blade 14 includes a first surface 81 having a substantially rectangular outer edge which fits within the upper blade outer edge 89. A cam contact point 54 protrudes from one outer edge of the lower blade 14, as illustrated in FIGS. 1 and 4. Gear racks 60 align on opposite outside edges of the lower blade 14 and include teeth that intermesh with gears 32 and 34. A second lower surface 82 extends substantially parallel to and below the first surface 81 and connects to the upper surface via braces 84, which extend from edges of the first surface 81 adjacent to the gear racks 60. A cutaway portion 56 is located on an edge of the lower surface 82 to form a unitary opening for the paper toweling when the lower blade 14 and the upper blade 12 are nested together.

The upper blade 12 is substantially similar to the lower blade 14. The upper blade 12 includes a first surface 91 having a substantially rectangular shape with an outer edge 89 extending outward along three edges. A biasing member attachment post 26 is positioned on outer edges. Gear racks 24 are positioned on the underside of the first surface 91 adjacent to the outer edge 89. A second lower surface 92, parallel to and below the first surface 91, is connected to the first surface via braces 85, as illustrated in FIG. 1. An cutaway portion 22 is located on an edge of the second surface 92 to align with the lower blade opening 56 to form a unitary opening for the paper toweling when the lower blade 14 and upper blade 12 are nested together.

The nesting relationship between the upper blade 12 and the lower blade 14 is necessary to provide a unitary opening of adjustable width that remains centered with respect to the base unit. The upper blade 12 and lower blade 14 nest together to form an adjustable blade unit that fits within the outer wall 73 of the base 17 and extends downward through the opening 67 in the base 17. The lower blade 14 fits within the outer edge 89 of upper blade 12 to allow the nesting relationship. The lower blade gear racks 60 and upper blade gear racks 24 are aligned when the blades are nested to fit around the gears 32 and 34, which are mounted on the gear mounts 64 of the base 17. The spacing of the teeth in each of the gear racks 60 and 24 are the same in order to provide for equal movement of the lower and upper blades relative to each other. Nesting of the blades aligns the lower blade cutaway portion 56 and the upper blade cutaway portion 22 to form a unitary opening through which the towel may pass. The relative positions of upper blade 12 and lower blade 14 can be adjusted to control the size of the unitary opening in order to provide for various dimensions and sizes of towels. The size of the unitary opening is maximized when the outside edges of the upper blade 12 and lower blade 14 contact the blade stops 66 of the base 17. One of ordinary skill in the art will understand that features of the lower blade and upper blade are not interchangeable.

The cam 16 provides for adjustment of the nested blades to control the size of the opening through which the toweling passes. The cam 16 includes a key post 36, which rotationally mounts into an opening 46 located in the slide 20. In a central region of the cam 16, an indexing flat 42 extends outward from the key post 36 and has an increasing radius. By way of example, at point 37, the radius is at its smallest length. Moving around the indexing flat 42 in a counterclockwise rotation as viewed in FIG. 1, the radius gradually increases to a maximum at point 39. A ratchet detent slot 40 is positioned on the indexing flat 42. A pin 48 extending from the bottom surface of slide 20 mounts within the ratchet slot 40 to control the amount of rotation of the cam 16. The pin 48 detents into the ratchet detent slot 40 to form friction points, thereby providing a ratcheting effect on the pin 48 on slide 20.

When the cam 16 is mounted, the indexing flat 42 contacts the cam contact point 54 of the lower blade. A cam adjustment aperture 93 positioned in the base 17 provides access to the cam 16 to allow a user to rotate the cam 16 and adjust the size of the unitary opening. The lower cam edge may be accessed through the cam adjustment aperture 93. The lower cam edge may include a slot for receiving a screwdriver head or other tool to assist in the adjustment. As the cam 16 is rotated, the indexing flat 42 controls the size of the unitary opening formed by the upper blade 12 and lower blade 14.

A biasing member 30 is mounted between the spring attachment 26 of the upper blade 12 and biasing member connector 62 of the base 17 to bias the blades outward to maintain contact with the cam 16. As the cam 16 is rotated, the biasing member 30 causes the cam contact point 54 to maintain contact with indexing flat 42.

The slide 20 includes an edge 96 which mounts within the base outer wall 73. A disengage lever 50 is positioned at one end of the slot and includes a locking tab 52 which mounts into a receiver 72 positioned on the cover 19. The disengage lever 50 is pliable to allow a user to disengage the locking tab 52 and move the slide 20 and cam 16 relative to the nozzle 10. The paper towel extends thought a slot 44 positioned within the slide. The slot 44 is sized to allow the slide 20 and cam 16 to be moved away from the nozzle without the entire slide being removed from the nozzle. In the preferred embodiment, the slot 44 is sized to allow the slide 20 to be pulled away from the nozzle a distance to provide for the maximum sizing of the unitary opening without completely removing the slide 20 from the nozzle.

The cover 19 is positioned on the outer edge of the slide 20 and fits within the outer wall 73 of the base 17. The cover 19 functions to keep debris, such as dust resulting from the tearing of the paper towels, from entering the dispenser nozzle 10 from the dispenser body 11 and potentially preventing the cam 16, upper blade 12, and lower blade 14 from functioning. A locking tab receiver 72 receives the slide-locking tab 52 to connect the cover 19 and slide 20. An opening, preferably having a funnel 70, allows the toweling to pass from the dispenser body 11 through the dispenser nozzle 10 and also protects the nozzle elements from debris. The funnel 70 nests inside nested upper blade 12 and lower blade 14 and extends below the respective planes of the first surface 91 of the upper blade 12 and first surface 81 of the lower blade 14.

In operation, the elements of the nozzle are fitted together to provide for dispensing the toweling to users. The cam contact point 54 of the lower blade is positioned against the cam indexing flat 42 to control the size of the unitary opening formed between the openings 56 and 22 of the upper blade 12 and lower blade 14, respectively. When the roll is finished, the slide 20 and attached cam 16 are slidingly removed a distance away from the lower funnel opening to allow the unitary opening to enlarge. Removal of the cam 16 from the cam contact point 54 results in the upper blade 12 and lower blade 14 being moved equally apart by the force of the biasing member 30 and in the unitary opening formed by the blades enlarging. The upper blade 12 and lower blade 14 are equally geared such that each move an equal distance. The upper blade 12 and lower blade 14 will continue to move apart until they individually contact blade stops 66 located on the base 17. At this point, the slide 20 and cam 16 are pulled away from the nozzle a distance to allow the blades to open to the maximum extent. The cam 16 has not rotated and is still in the same position as when contacting the cam contact point 54 of the lower blade 12.

By maximizing the size of the unitary opening, insertion of a new roll into the dispenser body 11 and feeding a roll end through the dispenser nozzle 10 is greatly simplified. After the roll end has been threaded through the dispenser nozzle 10, the user then pushes the slide 20 and cam 16 back to the original position within the dispenser nozzle 10. As the cam 16 is being moved inward, the cam indexing flat 42 contacts the cam contact point 54 of the lower blade 14. The force of the biasing member 30 is overcome by the force of the user, resulting in the blades repositioning to the same unitary opening size as before the insertion of the new roll. Once in position, the slide disengage lever 50 reengages with the cover locking tab receiver 72 to maintain the blades in the desired position. If necessary, the cam 16 can be adjusted by inserting a tool through the base cam adjust aperture 93 located in the base 17.

Certain modifications and improvements will occur to those skilled in the art upon a reading of the foregoing description. By way of example, means for protecting the nozzle elements from debris originating from outside the dispenser 11 may be affixed to or incorporated into the base 17. Such means may include a flat annular disk, rubber boot, or a downwardly extending funnel into which the nested blades extend. It should be understood that all such modifications and improvements have been deleted herein for the sake of conciseness and readability but are properly within the scope of the following claims.

The invention claimed is:

1. A dispenser for separating and releasing perforated towels from a continuous roll of towels, said dispenser comprising:

a base comprising an inner edge defining a base opening through which towels pass;

an upper blade comprising a curved edge, a second edge opposite said curved edge, and at least one gear rack extending along a side of said upper blade between said edges, a lower blade nesting between said upper blade and said base, said lower blade comprising a second curved edge positioned adjacent said curved edge of said upper blade to form an adjustable opening between said blades, said lower blade further comprising a second gear rack extending along a side of said lower blade substantially parallel to said gear rack of said upper blade;

at least one gear attached to said base in a position allowing the gear to control said gear racks on said upper blade and said lower blade;

a biasing member attached to one of said blades and further attached to said base such that one blade is a biased blade and the other blade is an unbiased blade; and a rotatable cam positioned on an end of said base opposite said biasing member and engaging said unbiased blade to prevent lateral movement of said unbiased blade past the outer edge of said cam; and wherein said biasing member pulls said biased blade outward toward one end of said base, and said gear moves said unbiased blade outward against said cam to form the adjustable opening between said blades, and wherein said adjustable opening is aligned with said base opening.

2. The dispenser of claim 1, wherein said cam comprises an indexing flat for engaging said unbiased blade and determining the extent to which said unbiased blade moves across said base.

3. The dispenser of claim 2, wherein rotation of said cam positions said indexing flat to control the extent to which said unbiased blade moves laterally along said base.

4. The dispenser of claim 2, wherein said lower blade comprises a cam contact point protruding from the edge of said lower blade opposite said curved edge, said cam contact point engaging said indexing flat of said rotatable cam.

5. The dispenser of claim 4, wherein said upper blade comprises a biasing member attachment post for connecting said upper blade to said biasing member.

6. The dispenser of claim 1, wherein said base comprises a second inner edge defining a cam adjustment aperture for accessing said cam and turning said cam to a desired position.

7. The dispenser of claim 1, further comprising a removable slide for covering said nesting blades and said base, said slide defining an interior opening aligned with said adjustable opening between said blades and said base opening to allow the passage of towels.

8. The dispenser of claim 7, wherein said removable slide is connected to said cam such that removal of said slide also removes said cam, thereby allowing said unbiased blade the maximum amount of lateral movement between the ends of said base.

9. The dispenser of claim 7, wherein said cam comprises an inner edge defining a ratchet slot in said cam and said removable slide comprises a pin extending from the lower surface of said slide, said pin engaging the ratchet slot of said cam to increase the force of friction between said slide and said cam.

10. The dispenser of claim 1, further comprising a cover positioned over said upper blade, said lower blade, and said base for reducing an amount of debris that may contact said upper blade and said lower blade.

11. The dispenser of claim 10, wherein said cover comprises a funnel extending downwardly at an angle from said base and connected to the adjustable opening for dispensing towels.

12. A dispenser for separating and releasing perforated towels from a continuous roll of towels, said dispenser comprising:

a base for supporting the roll of towels thereon, said base comprising an inner edge defining a base opening through which towels pass;

an upper blade connected to said base by a biasing member, wherein said biasing member is attached to one edge of said upper blade and one end of said base, said upper blade further comprising at least one upper gear rack extending along a side of said upper blade;

a lower blade nesting between said upper blade and said base, said lower blade further comprising at least one lower gear rack extending along a side of said lower blade, wherein said upper and lower blades each comprise a respective curved edge that together form an adjustable opening between said blades;

at least one gear attached to said base in a position allowing the gear to engage at least one of said gear racks on said upper blade and said lower blade; and a rotatable cam positioned on the end of said base opposite said biasing member, said cam exerting a lateral force against said lower blade, thereby controlling the rotation of said gear, said gear positioning said upper blade to form an adjustable opening between said blades that is aligned with said base opening, wherein the size of the adjustable opening is determined by the rotational position of said cam.

13. The dispenser of claim 12, wherein said upper blade and said lower blade each comprise a pair of substantially parallel gear racks extending from a respective curved edge toward the opposite edge of each blade, and said base comprises two gears mounted on opposite sides of the base opening, each of said gears intermeshing with at least one of said gear racks positioned on each of said upper and lower blades.

14. The dispenser of claim 12, further including a cam contact point positioned on said lower blade for providing a surface for contacting said cam.

15. The dispenser of claim 12, further including blade stops extending outward from one face of said base for contacting said upper blade and lower blade and controlling the maximum size of said adjustable opening.

16. The dispenser of claim 12, further including an outer wall extending about said base for containing said upper blade and lower blade within said base.

17. The dispenser of claim 12, wherein said cam further comprises an axial key post, wherein one end of said axial key post includes a tool mount for allowing adjustment of said cam.

18. The dispenser of claim 12, further including an exit funnel having an inlet end and an outlet, wherein said inlet end is removably attached to said base such that a passageway from said adjustable opening to said outlet is provided for an end of the continuous roll of towels.

19. The dispenser of claim 18, wherein said outlet has a first longitudinal axis and said adjustable opening has a second axis, and wherein said first axis and said second axis intersect to form an acute angle.

20. The dispenser of claim 12, wherein said base comprises a second inner edge defining a cam adjustment aperture for accessing said cam and turning said cam to a desired position.

21. The dispenser of claim 12, wherein said biasing member comprises a spring.

22. A dispenser for separating and releasing perforated towels from a continuous roll of towels, said dispenser comprising:

an upper blade comprising a first curved edge on one end and a biasing member attachment mechanism on the opposite end, said upper blade further comprising at least one upper gear rack extending between said curved edge and said biasing member attachment mechanism;

a lower blade comprising a second curved edge on one end, said lower blade further comprising at least one lower gear rack extending across said lower blade from said second curved edge toward the opposite end of said lower blade;

a base for supporting a roll of towels thereon and for holding said upper blade and said lower blade in a nesting relationship such that the first and second curved edges on each respective blade form an adjustable opening between said blades, said base comprising (i) an inner edge defining a base opening that aligns with the adjustable opening through which towels exit; (ii) at least one gear to control the position of said gear racks on said upper blade and said lower blade; and (iii) a biasing member connector on one end of said base;

a rotatable cam positioned on the end of said base opposite said biasing member connector and engaging the edge of said lower blade opposite said curved edge to prevent lateral movement of said lower blade past said cam; and a biasing member connecting said biasing member attachment mechanism on said upper blade and said biasing member connector on said base, wherein said biasing member pulls said upper blade outward toward said biasing member connector on said base, said gears move said lower blade outward against said cam, and said curved edges are equidistant from the center of the adjustable opening between said nesting blades.

23. The dispenser of claim 22, wherein said cam assembly comprises an axial key post and an indexing flat contacting said lower blade, said indexing flat having an increasing radius about its circumference, thereby forming a surface on the edge of said cam for stopping the lateral movement of said lower blade along said base.

24. The dispenser of claim 23, wherein said key post comprises a tool mount for allowing rotational adjustment of said cam.

25. The dispenser of claim 23, wherein said lower blade comprises a cam contact point protruding from the edge of said lower blade opposite said curved edge, said cam contact point engaging said indexing flat of said rotatable cam.

26. The dispenser of claim 22, wherein said biasing member comprises a spring.

27. The dispenser of claim 22, wherein said base comprises a second inner edge defining a cam adjustment aperture for accessing said cam and turning said cam to a desired position.

28. The dispenser of claim 22, further including blade stops extending outward from one face of said base for contacting said upper blade and lower blade and controlling the maximum size of said adjustable opening.

29. The dispenser of claim 22, further including an exit funnel having an inlet end and an outlet, wherein said inlet end is removably attached to said base such that a passageway from said adjustable opening to said outlet is provided for an end of said continuous roll.

30. The dispenser of claim 22, further comprising a cover positioned over said upper blade, said lower blade, and said base for reducing an amount of debris which may contact said upper blade and said lower blade.

31. The dispenser of claim 30, wherein said cover comprises a downward extending funnel aligned with said adjustable opening for dispensing the towels.

32. The dispenser of claim 31, wherein said funnel is angled in relation to the axis of said adjustable opening of said nesting blades.

* * * * *